US010012052B2

(12) United States Patent
Bergland et al.

(10) Patent No.: US 10,012,052 B2
(45) Date of Patent: Jul. 3, 2018

(54) DOWNHOLE TOOL DEVICE AND METHOD FOR USING THE SAME

(71) Applicant: TARGET Intervention AS, Algard (NO)

(72) Inventors: Kenneth Bergland, Stavanger (NO); Stig Bakke, Algard (NO); Thomas Berge, Hafrsfjord (NO); Stian Bjerkeseth, Sandnes (NO); Oddbjorn Vagle, Sandnes (NO)

(73) Assignee: TARGET Intervention AS, Algard (NO)

( * ) Notice: Subject to any disclaimer, the term of this patent is extended or adjusted under 35 U.S.C. 154(b) by 116 days.

(21) Appl. No.: 14/779,744

(22) PCT Filed: Mar. 26, 2014

(86) PCT No.: PCT/NO2014/050043
§ 371 (c)(1),
(2) Date: Sep. 24, 2015

(87) PCT Pub. No.: WO2014/158028
PCT Pub. Date: Oct. 2, 2014

(65) Prior Publication Data

US 2016/0047197 A1 Feb. 18, 2016

(30) Foreign Application Priority Data

Mar. 27, 2013 (NO) ..... 20130437

(51) Int. Cl.
*E21B 33/124* (2006.01)
*E21B 43/26* (2006.01)
(Continued)

(52) U.S. Cl.
CPC ..... *E21B 33/124* (2013.01); *E21B 23/01* (2013.01); *E21B 33/1293* (2013.01);
(Continued)

(58) Field of Classification Search
CPC .... E21B 23/01; E21B 33/124; E21B 33/1293; E21B 34/06; E21B 43/26; E21B 47/12
See application file for complete search history.

(56) References Cited

U.S. PATENT DOCUMENTS 4,216,827 A 8/1980 Crowe
8,353,348 B2 1/2013 Chitwood et al.
(Continued)

FOREIGN PATENT DOCUMENTS

EP 2105577 A1 9/2009
EP 2236738 A2 10/2010
(Continued)

OTHER PUBLICATIONS

International Search Report and Written Opinion for PCT/NO2014/050043 dated Jun. 26, 2014.
(Continued)

*Primary Examiner* — James G Sayre
(74) *Attorney, Agent, or Firm* — Andrus Intellectual Property Law, LLP

(57) ABSTRACT

A downhole tool is arranged for connection to a fluid-carrying string. The downhole tool includes: a first reversibly expandable sealing element; a second reversibly expandable sealing element placed at an axial distance from the first reversibly expandable sealing element; one or more fluid ports positioned between the two reversibly expandable sealing elements and arranged to be put in fluid communication with the fluid-carrying string; a first anchoring device arranged to engage a pipe body in a well; and one or more electromotors arranged at least to operate the two reversibly expandable sealing elements and the first anchoring device. The downhole tool further includes a first mechanically activatable release mechanism arranged at least to disengage
(Continued)

the first anchoring device from the pipe body. A method is for utilizing a downhole tool.

17 Claims, 8 Drawing Sheets

(51) Int. Cl.

| | |
|---|---|
| ***E21B 47/12*** | (2012.01) |
| ***E21B 33/129*** | (2006.01) |
| ***E21B 34/06*** | (2006.01) |
| ***E21B 23/01*** | (2006.01) |

(52) U.S. Cl.
CPC ..... *E21B 34/06* (2013.01); *E21B 43/26* (2013.01); *E21B 47/12* (2013.01)

(56) References Cited

U.S. PATENT DOCUMENTS

| | | | | |
|---|---|---|---|---|
| 2009/0044944 | A1* | 2/2009 | Murray | E21B 43/02 166/308.1 |
| 2012/0090847 | A1* | 4/2012 | Getzlaf | E21B 23/02 166/305.1 |
| 2015/0075783 | A1* | 3/2015 | Angman | E21B 43/26 166/250.01 |
| 2016/0298423 | A1* | 10/2016 | Getzlaf | E21B 23/02 |

FOREIGN PATENT DOCUMENTS

| | | | | |
|---|---|---|---|---|
| GB | 2300441 | A * | 11/1996 | E21B 23/06 |
| WO | 2011037586 | A1 | 3/2011 | |

OTHER PUBLICATIONS

International Preliminary Report on Patentability for PCT/NO2014/050043 dated Mar. 24, 2015.

* cited by examiner

DOWNHOLE TOOL DEVICE AND METHOD FOR USING THE SAME

CROSS-REFERENCE TO RELATED APPLICATIONS

This application is the U.S. national stage application of International Application PCT/NO2014/050043, filed Mar. 26, 2014, which international application was published on Oct. 2, 2014, as International Publication WO2014/158028 in the English language. The international application is incorporated herein by reference, in entirety. The international application claims priority to Norwegian Patent Application No. 20130437, filed Mar. 27, 2013, which is incorporated herein by reference, in entirety.

FIELD

The present invention relates to a downhole tool device. More specifically, the invention relates to a downhole tool device arranged for connection to a fluid-carrying string, the downhole tool including a first reversibly expandable sealing element; a second reversibly expandable sealing element placed at an axial distance from the first reversibly expandable sealing element; one or more fluid ports positioned between the two reversibly expandable sealing elements and arranged to be put in fluid communication with the fluid-carrying string; a first anchoring device arranged to engage a pipe body in a well; and one or more electromotors arranged at least to operate the two reversibly expandable sealing elements and the first anchoring device.

BACKGROUND

It is known to break up (fracture) and stimulate formations surrounding underground wells to increase the rate of recovery of hydrocarbons from the wells. According to the prior art, fracturing and stimulation, by means of wireline technology as well as fluid-carrying strings, have been time-consuming and expensive. By the use of a wireline, bridge plugs with a diameter that is slightly smaller than the inner diameter of the well path have been pumped down the well to below a perforated zone which is to be stimulated and/or fractured. The entire annulus outside the wireline above the plug must be pressured up. The bridge plug is generally dependent on a clean well path in order to be moved in the well, and then in particular to be pumped past perforated casings. Therefore, there has generally been a need to clean the well after each perforating operation. As the wireline has a limited breaking strength, the well plugs must usually be left in the well and be drilled out later, which reduces the effective diameter of the well after the operation. It is not possible to fracture and/or stimulate an isolated zone by means of wireline technology. Fluid-carrying strings like production tubing or coiled tubing have been used for stimulation and fracturing as well. A challenge has been to provide enough power for a fracturing and/or stimulating tool downhole. The power loss in long downhole electric transmission cables may be considerable, and the upper permissible transmission voltage has been set by official requirements. Both downhole generators and electromotors must be limited in size because of the limited diameter of the wellbore. Downhole electromotors are therefore limited in power. It is a challenge to provide sufficient forces for carrying out different operations downhole.

SUMMARY

The invention has for its object to remedy or reduce at least one of the drawbacks of the prior art or at least provide a useful alternative to the prior art.

The object is achieved through features which are specified in the description below and in the claims that follow.

In a first aspect, the invention relates to a downhole tool device arranged for connection to a fluid-carrying string, the downhole tool including:

a first reversibly expandable sealing element;

a second reversibly expandable sealing element placed at an axial distance from the first reversibly expandable sealing element;

one or more fluid ports positioned between the two reversibly expandable sealing elements and arranged to be put in fluid communication with the fluid-carrying string;

a first anchoring device arranged to engage a pipe body in a well; and one or more electromotors arranged at least to operate the two reversibly expandable sealing elements and the first anchoring device, characterized by the downhole tool further including:

a first mechanically activatable release mechanism arranged at least to disengage the first anchoring device from the pipe body.

The downhole tool according to the invention may be particularly well suited for stimulating and/or fracturing underground formations for increased recovery of hydrocarbons. The downhole tool according to the invention may also be used in long horizontal, or partially horizontal, wells. The first anchoring device, which may be slips of a kind known per se, is arranged to hold the tool steady during stimulation and/or fracturing. Large pressure differences between an annulus between the two reversibly expandable sealing elements, when these are in an expanded position, and the well pressure will cause great forces to act axially on the downhole tool and, thus, try to move it. In normal operation, the reversibly expandable sealing elements and the anchoring device may be activated and deactivated by the at least one electromotor, but in a case in which communication between the surface and the downhole tool is broken, whether it be electric, hydraulic, pneumatic or optical-fibre communication, or if the at least one electromotor fails, it may be advantageous that the first release mechanism is mechanically activatable. The release mechanism, which may be of a type known per se, may be activated by an axial force being supplied to it via the fluid-carrying string. The chance of the downhole tool not being releasable if it gets stuck or if the communication fails is thereby reduced.

The sealing elements may be arranged to be expanded and deactivated by means of axial force applied. During normal use, the axial force will come from the at least one electromotor.

In one embodiment, the first mechanically activatable release mechanism may include a piston which is in contact with both a fluid in the annulus between the two sealing elements, when these are in the expanded position, and a fluid in the well outside the first expanded sealing element. The pressure difference between the two fluids brings about a movement of the piston. The movement of the piston further controls a locking mechanism in the form of several adjustable locking dogs/locking arms. The locking mechanism allows the first, expanded sealing element and the first anchoring device to be deactivatable/releasable if the downhole tool is subjected to a mechanical pull force that is greater than a predetermined value.

The first anchoring device may include three or more wedge segments with toothed outer surfaces. The wedge segments may be symmetrically distributed around the centre axis of the downhole tool, and the wedge segments may be arranged to engage a pipe body in the well by the wedge segments being displaced axially so that sloped faces on the wedge segments are displaced against sloped sliding surfaces on the downhole tool while, at the same time, normal faces on the wedge segments abut against sliding surfaces normal to the longitudinal direction of the downhole tool and thus are set radially out against the pipe body in a manner known per se. As the wedge segments usually operate in fluids with high particle density, it may be appropriate to use spring-loaded guide grooves in the sliding surfaces, wherein the spring loading presses/pulls the wedge segments against the sliding surfaces to prevent separation between the sliding surfaces. Thus, the wedge segments may be forced into a disengaged position. The guide groove which is spring-loaded towards the sliding surface normal to the longitudinal direction of the downhole tool may further be angled somewhat inwards towards the centre axis of the downhole tool so that the springing will be effective in towards the centre axis of the downhole tool.

The fluid-carrying string may be coiled tubing or a drill string, for example. The fluid-carrying string may also be provided with cables for transmitting electrical power from the surface down the well and also two-way communication between the downhole tool and the surface. It may be an E-coil, for example.

In one embodiment, the first mechanically activatable release mechanism may further be arranged to deactivate the first reversibly expandable sealing element from an expanded position. Pressure differences between the two sealing elements, when these are in an expanded position, and the well pressure may thereby be equalized, and it will be easier to move the downhole tool by means of the fluid-carrying string.

The downhole tool may further include a second mechanically activatable release mechanism arranged to deactivate the second reversibly expandable sealing element from an expanded position. In the same way as described above for the first release mechanism, the second mechanically activatable release mechanism may be activated by providing an axial force via the fluid-carrying string. In one embodiment, the second mechanically activatable release mechanism may be arranged to be activated by a smaller axial force than the first mechanically activatable release mechanism. The second mechanically activatable release mechanism may be connected to the fluid-carrying string. Practically all mechanically applied tensile forces that are transferred to the downhole tool from the fluid-carrying string may be transferred via shear pins or the like. If shear pins are ruptured, further movement of the fluid-carrying string, which is still attached to the downhole tool, will result in locking dogs/locking arms being deactivated and the holding force on the second sealing element being relieved and the sealing element being deactivated.

In one embodiment, the downhole tool may further include a first release valve arranged to equalize a pressure difference in an annulus between the two reversibly expandable sealing elements, when these are in an expanded position, and an annulus outside the first reversibly expandable sealing element. The first release valve may be appropriate in order to equalize the pressure difference in the annulus between the two reversibly expandable sealing elements, when these are in an expanded position, and the well pressure without deactivating one of the reversibly expandable sealing elements. The first release valve may be operable by the at least one electromotor during normal operation. In addition, it may be possible, in one embodiment, to open the first release valve mechanically by means of the above-mentioned first mechanically activatable release mechanism. This could make it easier to release the downhole tool mechanically, if required. The first release valve may be a slide valve. The slide valve may include an outer sleeve arranged to be moved axially relative to an inner sleeve with radial openings. The axial movement could open and close to flow through valve ports.

The downhole tool may further include a second release valve arranged to equalize a pressure difference in an annulus between the two reversibly expandable sealing elements, when these are in an expanded position, and an annulus outside the second reversibly expandable sealing element. The second release valve may be a slide valve.

In one embodiment, the downhole tool may include a second anchoring device arranged to engage a pipe body in the well, wherein the second anchoring device is placed at the opposite end of the downhole tool to the first anchoring device. The second anchoring device may include, for example, shear pins operable by means of the at least one electromotor and breakable, if required, by the second mechanically activatable release mechanism.

In one embodiment, at least one of said mechanically activatable release mechanisms may be arranged to release/deactivate/open both an anchoring device, an expandable sealing element and a release valve in the same operation. The expanded sealing element and the anchoring device may then be connected in series with the axial movement by the fluid-carrying string, whereas the release valve may be connected in parallel with the axial movement so that the release valve may be opened and a possible pressure difference may be equalized before the sealing elements are deactivated.

Further, at its distal end, the downhole tool may be provided with a one-way valve arranged to direct fluids past the downhole tool upwards in the well. The one-way valve could be appropriate in order to make it easier to move the downhole tool down the well, by enabling displaced mass to be circulated upwards in the well, and to equalize a possible pressure difference between the bottom side and the top side of the tool.

In one embodiment, the downhole tool may include two individually operable electromotors spaced apart axially. Each electromotor may be arranged to operate one reversibly expandable sealing element and one possible, adjacent release mechanism and release valve. Opposite ends of the downhole tool may thus be operated independently of each other, which could reduce the need for electrical power transferred from the surface down to the downhole tool. Thus, it will not be necessary to transfer forces from an electromotor over long axial distances in the downhole tool either, the downhole tool possibly being several meters long.

The downhole tool may further include a device arranged to locate perforations in a pipe body. This may be appropriate in order to achieve good positioning accuracy of the downhole tool relative to perforations in a casing in the well if the tool is to be used to stimulate and/or fracture the underground formation surrounding the well. The device for locating the perforations may be a so-called CCL (Casing Collar Locator), and it may be of an electric or mechanical type. Further, the downhole tool may also include a device for locating pipe joints. The device for locating pipe joints may be the same as the device for locating perforations, or it may be a separate device.

In one embodiment, the downhole tool may be arranged for two-way communication with the surface via the fluid-carrying string. This may be done by providing the fluid-carrying string with communication cables of types known per se. With two-way communication, it will be possible both to control the downhole tool from the surface and to receive information on the downhole operation. It could thus be an advantage if the communication is in real time, for example via electrical or optical-fibre cables integrated in the fluid-carrying string. The downhole tool may be equipped with one or more pressure gauges arranged to measure the pressure in different pressure regimes along the downhole tool. The pressure read by said pressure gauges may thus be read at the surfaces.

In one embodiment, the first mechanically activatable release mechanism may be arranged to be deactivated when the pressure difference between the portion between the two reversibly activatable sealing elements, when these are in an expanded position, and the well pressure exceeds a set value. This could be particularly beneficial in order to avoid moving the downhole tool during a stimulation or fracturing process in which there is a large overpressure in the annulus between the expanded sealing elements. The deactivation may also take place by a piston, which is preloaded by a spring, being in contact with both the stimulating fluid and a fluid below the tool, that is to say outside the first, expanded sealing element. The pressure difference between said fluids could displace the piston in the direction away from the overpressure. The displacement of the piston further adjusts a locking mechanism in the form of several adjustable locking dogs/arms. The locking mechanism has the effect of making the first release mechanism of the tool be deactivated when the pressure difference exceeds a predetermined value. In practice, this will mean that the first anchoring mechanism cannot be disengaged, and that the first, expanded sealing element cannot be deactivated and that a possible first release valve cannot be opened when the pressure difference is above the predefined value. Axial pull forces will, if anything, cause further anchoring of the first anchoring mechanism. If the pressure difference is smaller than the predefined value, the first release mechanism may be activated by an axial pull force as mentioned above. The predefined, set value for the pressure difference may be calibrated by adjusting the resistance of the above-mentioned spring.

In one embodiment, the at least one electromotor may include a harmonic drive. The gear could thereby be made very compact while, at the same time, high gear ratios may be achieved. This may be appropriate in a well in which there is both limited space and limited supply of electrical power.

Further, the at least one electromotor may be arranged to operate the two reversibly expandable sealing elements via a linear actuator, such as a roller screw. Good positioning accuracy may thereby be achieved while, at the same time, great forces are transmitted to the above-mentioned sealing elements, valves and anchoring devices.

In one embodiment, the at least one electromotor may be placed between the two reversibly expandable sealing elements. This may be appropriate as axial forces from a possible overpressure between the reversibly expandable sealing elements, when these are in the expanded position, will work in the same direction on the sealing elements as the at least one electromotor, which expands the sealing elements by means of a piston that is displaced by the linear actuator. As the sealing elements are subjected, in the main, to pressure from one side, an area may be provided in addition to the cross-sectional area of the sealing element, for the pressure to act on. This may be done by an unsupported sleeve travelling together with the sealing element, forming an activation shoulder for the sealing element. The requirement for necessary setting force from the electromotors is thereby reduced considerably. That is to say, the overpressure could help to further set the reversibly expandable sealing elements, which may be elastic packers of types known per se, in sealing contact with the inside of a pipe body in the well. Correspondingly, the overpressure could help to increase the setting force on the first anchoring device.

In a second aspect, the invention relates to a method of stimulating and/or fracturing a formation surrounding an underground well by means of a downhole tool according to claim 1, the method including the steps:

(A) connecting the downhole tool to a fluid-carrying string;

(B) by means of the fluid-carrying string, moving the downhole tool down the well to a perforated pipe body;

(C) expanding the two reversibly expandable sealing elements into engagement with the perforated pipe body, so that one or more perforations in the pipe body are located between the two expanded sealing elements;

(D) by means of the first anchoring device, anchoring the downhole tool in the perforated pipe body in the well;

(E) via the fluid-carrying string, carrying a stimulating and/or fracturing fluid to the surrounding formation via the fluid ports in the downhole tool and further out through the perforations of the pipe body;

(F) after the stimulation and/or fracturing has been carried out, deactivating the expanded sealing elements and disengaging the first anchoring device from the pipe body.

The method may further include repeating the steps (C)-(F) cyclically one or more times.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1:
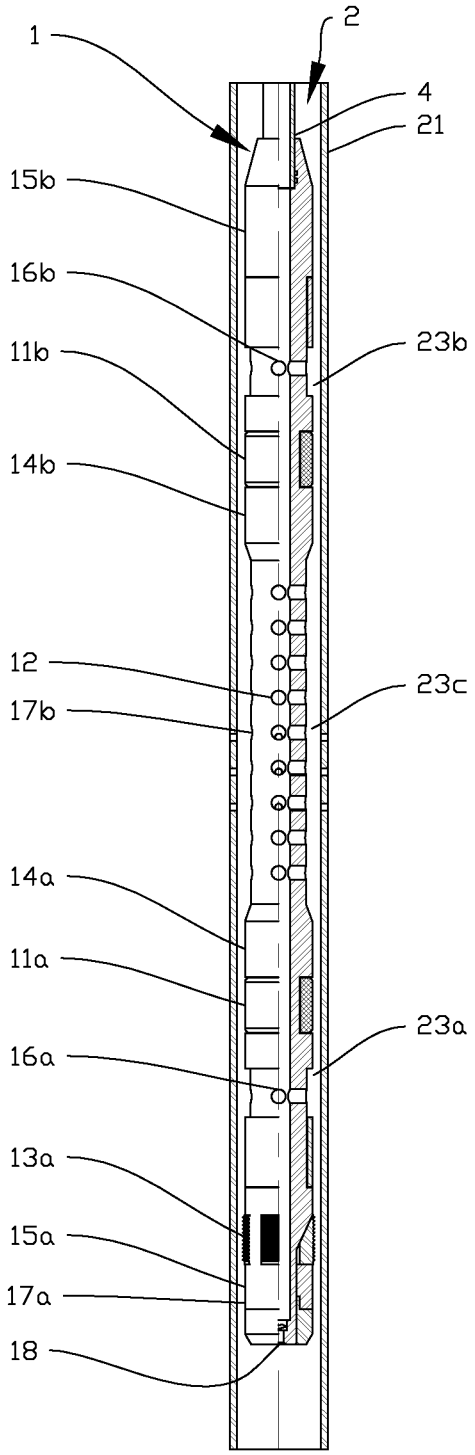
FIG. 1 shows, in a side view and partially in section, a downhole tool according to the present invention in an active position.

In what follows, the reference numeral 1 indicates a downhole tool in accordance with the present invention. The figures, which are shown in a schematic and simplified manner, are shown partially in section for the sake of exposition.

In the figures, the proximal end of the downhole tool 1 is shown connected to a fluid-carrying string 4 in the form of coiled tubing in a well 2. The well 2 is provided with a pipe body 21 in the form of casing. The downhole tool 1 includes a first reversibly expandable sealing element 11*a* positioned at an axial distance from a second reversibly expandable sealing element 11*b*. The sealing elements 11*a*, 11*b* are arranged to seal against the inside of the casing 21. Between the sealing elements 11*a*, 11*b*, the downhole tool 1 is formed with a plurality of fluid ports 12. The fluid ports 12 are in fluid communication with the coiled tubing 4, and a stimulation or fracturing fluid can be carried from the surface, through the coiled tubing 4 and out through the fluid ports 12. In the embodiment shown, the downhole tool 1 is further provided with two electromotors 14*a*, 14*b* placed between the two reversibly expandable sealing elements 11*a*, 11*b* and spaced apart axially. The two electromotors 14*a*, 14*b* can be operated independently of each other. A first electromotor 14*a* is arranged to operate the first reversibly expandable sealing element 11*a*, a first release valve 16*a* and a first anchoring device 13*a*. The second electromotor 14*b* is arranged to operate the second reversibly expandable sealing element 11*b* and a second release valve 16*b*. The functions of the various components will be described in more detail below. The downhole tool 1 is further provided with electrical devices 17*a*, 17*b* for locating pipe joints and perforations 211, respectively, in the casing 21. A first mechanically activatable release mechanism 15*a* is arranged to disengage the first anchoring device 13*a*, to deactivate the first sealing element 11*a* from an expanded position and to open the first release valve 16*a*. The first mechanically activatable release mechanism 15*a* is activated by applying an axial pull force to the downhole tool 1 via the coiled tubing 4. Correspondingly, a second mechanically activatable release mechanism 15*b* is arranged to deactivate the second reversibly expandable sealing element 11*b* and to open the second release valve 16*b*. A one-way valve 18 is placed at the distal end of the downhole tool 1. The one-way valve 18 is arranged to direct well fluids through the downhole tool 1 in the direction from the distal end to the proximal end.

In FIG. 1, the downhole tool 1 is shown in a non-activated position. The valves 16*a*, 16*b*, 18 are open and the sealing elements 11*a*, 11*b* and the first anchoring device 13*a* are non-expanded/non-activated; that is to say, have not been engaged with the inside of the casing 21.

Figure 2:
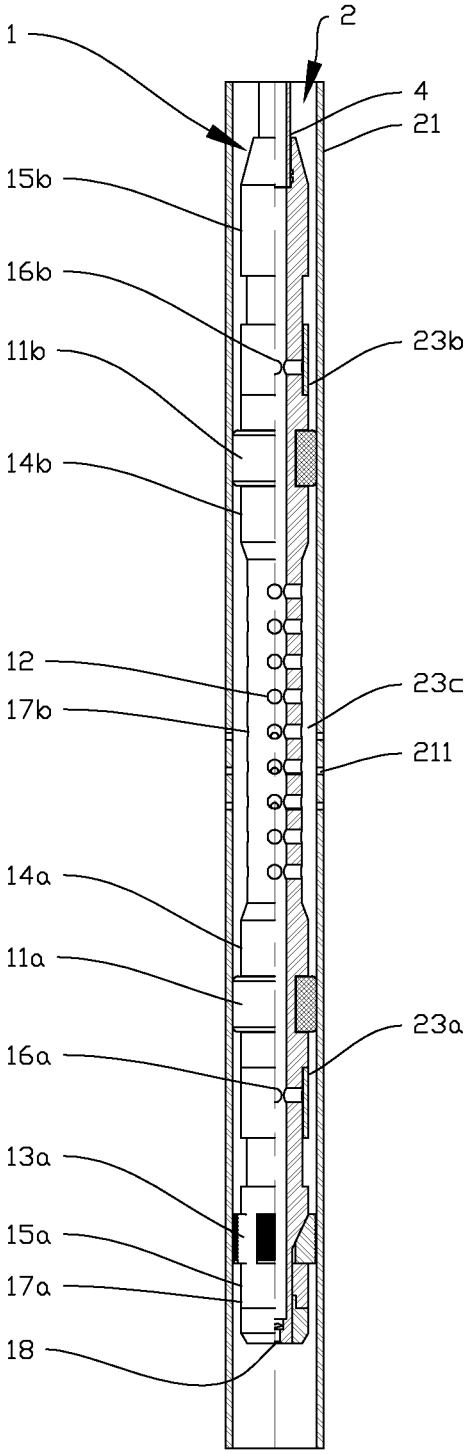
FIG. 2 shows, in a side view and partially in section, the downhole tool of FIG. 1 in an active position.

In FIG. 2 the downhole tool 1 is shown after the sealing elements 11*a*, 11*b* have been fluid-sealingly engaged with the inside of the casing 21, the release valves 16*a*, 16*b* being closed, whereas the first anchoring device 13*a*, shown as slips in the figures, has mechanically anchored the downhole tool 1 to the casing 21.

In the FIGS. 3 to 8 is shown a method of stimulating and/or fracturing an underground formation, not shown, surrounding the well 2.

Figure 3:
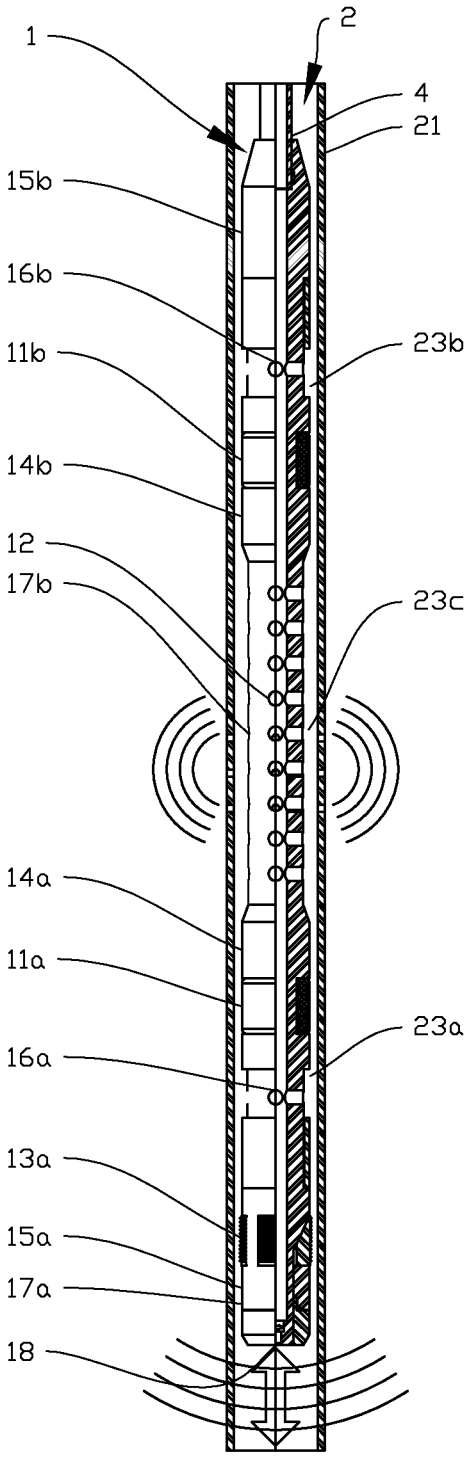
FIGS. 3-8 show, in side views and partially in sections, a downhole tool according to the present invention which is used to stimulate and/or fracture an underground formation.

In FIG. 3, the downhole tool is run down the well 2 while the devices 17*a*, 17*b* for locating pipe joints and perforations are active in order to find the desired position for the downhole tool 1. The position of the downhole tool 1 in the well 2 is communicated in real time to the surface.

Figure 4:
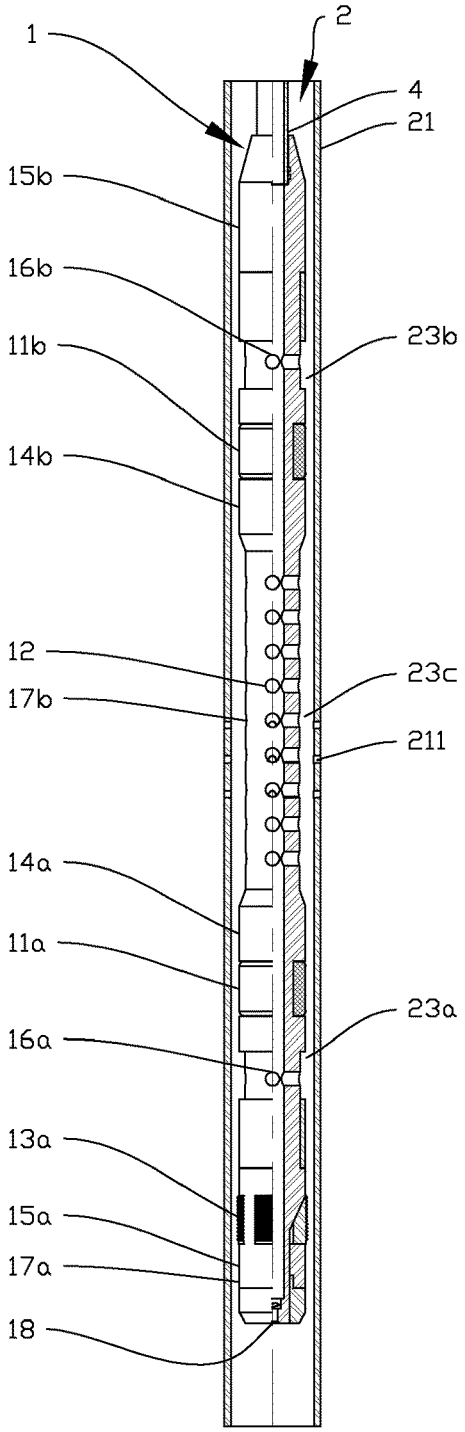

In FIG. 4, the downhole tool 1 is shown as the locating devices 17*a*, 17*b* have found a suitable place for stimulation and/or fracturing. The fluid ports 12 are then positioned opposite the perforations 211 of the casing 21.

Figure 5:
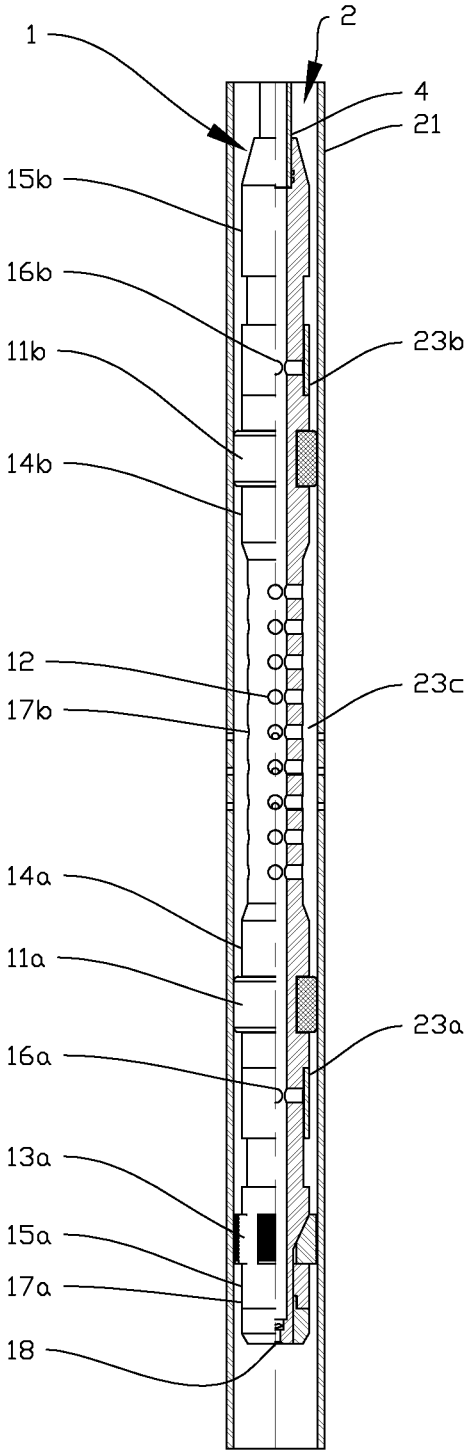
Figure 6:
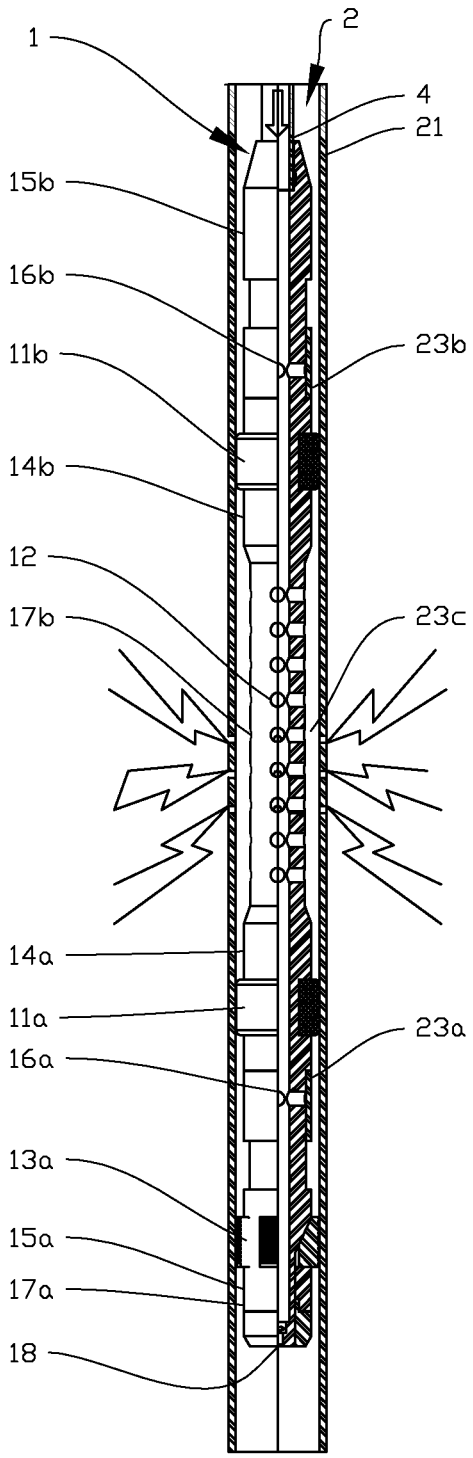

FIG. 5 shows the downhole tool 1 as it is being prepared for stimulation and/or fracturing. The first electromotor 14*a* is activated and, by a roller screw, not shown, pushing a piston, the first release valve 16*a* is closed, the first reversibly expandable sealing element 11*a* is expanded into sealing engagement with the casing 21 and the slips 13*a* are forced out into mechanical engagement with the inside of the casing 21. Further, the second electromotor 14*b* is activated so that the second reversibly expandable sealing element 11*b* is expanded and the second release valve 16*b* is closed. An annulus 23*c* between the two expanded sealing elements 11*a*, 11*b* is now sealed, in terms of fluid, from the annulus 23*a*, 23*b* outside the first expanded sealing element 11*a* and the second expanded sealing element 11*b*, respectively. Stimulating and/or fracturing fluids are then pressurized through the coiled tubing 4, carried through the fluid ports 12 and into the formation through the perforations 211 of the casing 21. The downhole tool may be provided with pressure sensors, not shown, arranged to measure pressures between the expanded sealing elements 11*a*, 11*b* and on the outside of the expanded sealing elements 11*a*, 11*b*. The sensed pressures may be communicated to the surface and the pressure sensors could give an indication of the integrity of the expanded sealing elements 11*a*, 11*b*, among other things.

Figure 7:
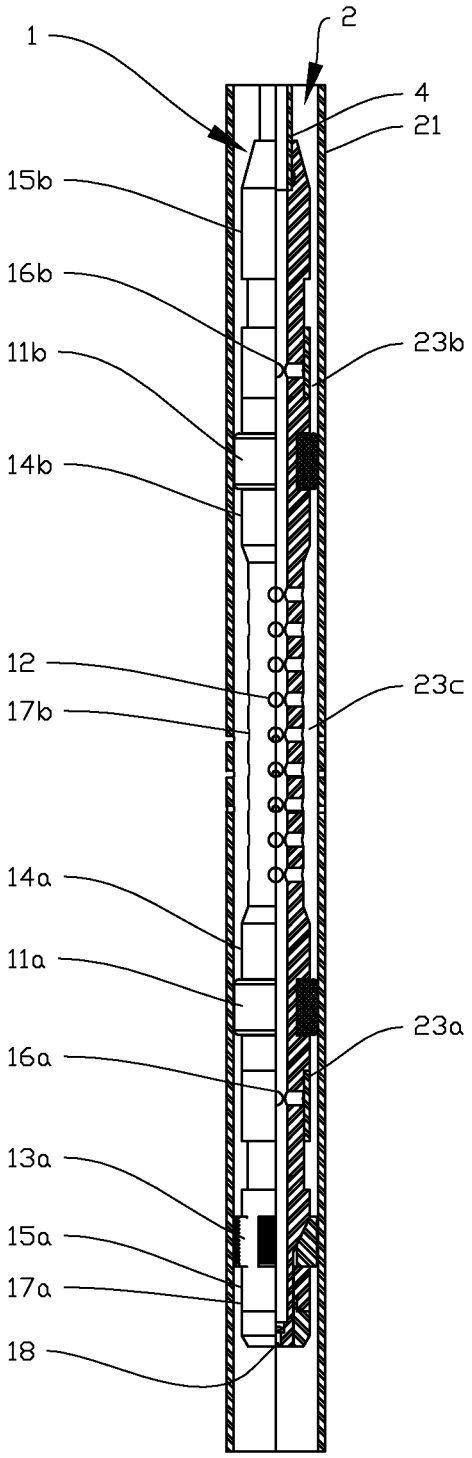

In FIG. 7, a downhole tool 1 is shown after the stimulation and/or fracturing operation has been carried out. The electromotors 14*a*, 14*b* are activated again, one at a time. The pressure difference between the annulus 23*c* between the expanded sealing elements 11*a*, 11*b* and the annuli 23*a*, 23*b* outside the sealing elements 11*a*, 11*b* is equalized by opening the release valves 16*a*, 16*b*. The expanded sealing elements 11*a*, 11*b* may then be deactivated into their unexpanded position, and the slips 13*a* may be retracted so that the mechanical engagement with the casing 21 ceases to exist.

Figure 8:
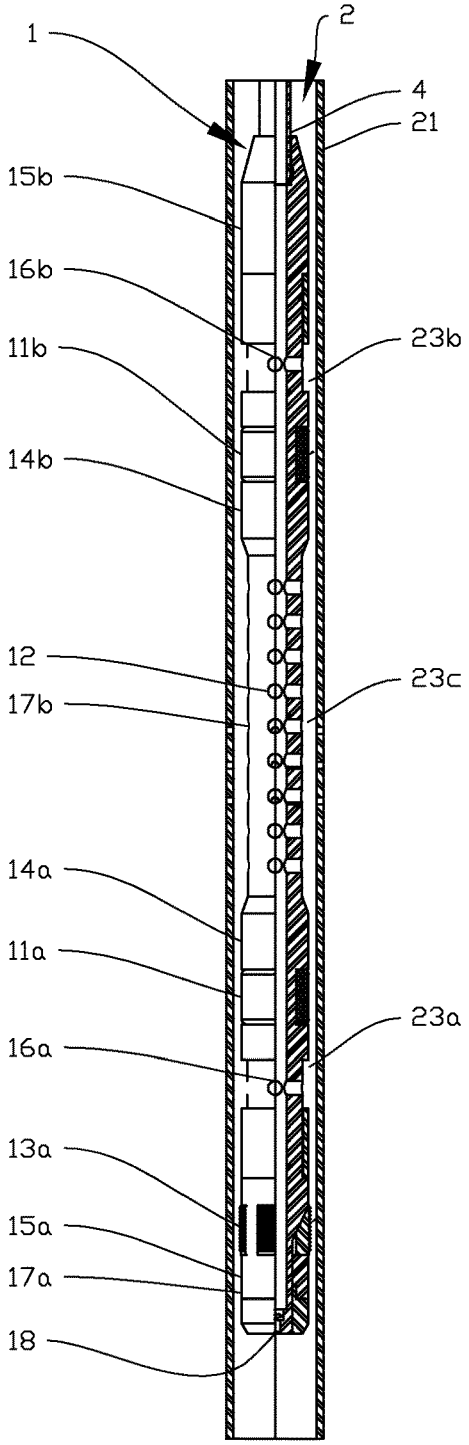

In FIG. 8, the downhole tool is shown once again in its deactivated position as it is about to be moved into a new zone in the well 2 which is to be stimulated and/or fractured.

If the downhole tool 1 should get stuck or loose the communication/power supply from the surface, the downhole tool 1 may be released mechanically by means of the first release mechanism 15*a* and the second release mechanism 15*b* as described above.

The invention claimed is:

1. A downhole tool configured for connection to a fluid-carrying string, the downhole tool comprising:

a first reversibly expandable sealing element;

a second reversibly expandable sealing element placed at an axial distance from the first reversibly expandable sealing element;

one or more fluid ports positioned between the first and second reversibly expandable sealing elements and configured to be put in fluid communication with the fluid-carrying string;

a first anchoring device configured to engage a pipe body in a well;

one or more electromotors configured at least to operate the first and second reversibly expandable sealing elements and the first anchoring device; and:

a first mechanically activatable release mechanism, activatable by an axial force being supplied thereto via the fluid-carrying string, and configured at least to disengage the first anchoring device from the pipe body.

2. The downhole tool according to claim 1, wherein the first mechanically activatable release mechanism is further configured to deactivate the first reversibly expandable sealing element from an expanded position.

3. The downhole tool according to claim 1, further comprising a second mechanically activatable release mechanism, activatable by an axial force being supplied thereto via the fluid-carrying string, configured to deactivate the second reversibly expandable sealing element from an expanded position.

4. The downhole tool according to claim 1, further comprising a first release valve configured to equalize a pressure difference in an annulus between the first and second reversibly expandable sealing elements, when the sealing elements are in an expanded position, and an annulus outside the first reversibly expandable sealing element.

5. The downhole tool according to claim 1, further comprising a second release valve configured to equalize a pressure difference in an annulus between the first and second reversibly expandable sealing elements, when the sealing elements are in an expanded position, and an annulus outside the second reversibly expandable sealing element.

6. The downhole tool according to claim 1, further comprising a second anchoring device configured to engage the pipe body in the well, the second anchoring device being placed at the opposite end of the downhole tool to the first anchoring device.

7. The downhole tool according to claim 1, wherein, at a distal end, the downhole tool is provided with a one-way valve.

8. The downhole tool according to claim 1, further comprising two axially spaced-apart, individually operable electromotors.

9. The downhole tool according to claim 1, further comprising a device configured to locate perforations in a pipe body.

10. The downhole tool according to claim 1, further comprising a device for locating pipe joints.

11. The downhole tool according to claim 1, wherein the downhole tool is configured for two-way communication with the surface via the fluid-carrying string.

12. The downhole tool according to claim 1, wherein the downhole tool is configured for real-time communication with the surface via the fluid-carrying string.

13. The downhole tool in accordance with claim 1, wherein the first mechanically activatable release mechanism is configured to be deactivated when a pressure difference between the annulus between the first and second reversibly expandable sealing elements, when the sealing elements are in an expanded position, and well pressure exceeds a set value.

14. The downhole tool according to claim 1, wherein the at least one electromotor is arranged to operate the two reversibly expandable sealing elements via a roller screw.

15. The downhole tool according to claim 1, wherein the one or more electromotors is configured between the first and second reversibly expandable sealing elements.

16. A method of stimulating or fracturing a formation surrounding an underground well by a downhole tool according to claim 1, the method comprising:

(A) connecting the downhole tool to the fluid-carrying string;

(B) by the fluid-carrying string, moving the downhole tool down the well to the pipe body;

(C) expanding the first and second reversibly expandable sealing elements into engagement with the pipe body, so that one or more perforations formed in the pipe body are located between the expanded first and second sealing elements;

(D) by a first anchoring device, anchoring the downhole tool to the perforated pipe body in the well;

(E) via the fluid-carrying string, carrying a stimulating and/or fracturing fluid to the surrounding formation via the fluid ports of the downhole tool and further out through the one or more perforations of the pipe body to provide stimulation or fracturing;

(F) after the stimulation or fracturing has been carried out, deactivating the expanded first and second sealing elements and disengaging the first anchoring device from the pipe body.

17. The method according to claim 16, wherein the method further comprises repeating the steps (C)-(F) cyclically one or more times.

* * * * *